US010940488B2

(12) United States Patent
Dimmelmeier et al.

(10) Patent No.: US 10,940,488 B2
(45) Date of Patent: Mar. 9, 2021

(54) DEVICE FOR SLURRYING A SUSPENSION AND METHOD FOR OPERATING A DEVICE

(71) Applicant: OSRAM Opto Semiconductors GmbH, Regensburg (DE)

(72) Inventors: Harald Dimmelmeier, Regensburg (DE); Stefan Barthel, Regensburg (DE); Simon Jerebic, Donaustauf (DE); Benedikt Beer, Regensburg (DE); Harald Laux, Regensburg (DE)

(73) Assignee: OSRAM OLED GMBH, Regensburg (DE)

( * ) Notice: Subject to any disclaimer, the term of this patent is extended or adjusted under 35 U.S.C. 154(b) by 151 days.

(21) Appl. No.: 16/221,350

(22) Filed: Dec. 14, 2018

(65) Prior Publication Data

US 2019/0184407 A1 Jun. 20, 2019

(30) Foreign Application Priority Data

Dec. 14, 2017 (DE) ..... 10 2017 129 997.1

(51) Int. Cl.
*B01F 5/16* (2006.01)
*B03D 1/14* (2006.01)

(52) U.S. Cl.
CPC ..... *B03D 1/1456* (2013.01); *B01F 5/16* (2013.01)

(58) Field of Classification Search
CPC .. B01F 5/16; B01F 5/0231; B01F 5/10; B01F 3/1221; B01F 7/002; B01F 7/00591; B01F 7/00916; B01F 7/0095; B01F 7/163
See application file for complete search history.

(56) References Cited

U.S. PATENT DOCUMENTS 2,592,904 A * 4/1952 Jackson ..... B01F 5/0231 366/168.2
3,244,409 A 4/1966 Delorme
4,044,079 A * 8/1977 Tveit ..... B01F 5/0206 261/36.1
5,620,250 A * 4/1997 Chilcoat ..... B01F 5/0218 239/233

(Continued)

FOREIGN PATENT DOCUMENTS

DE 19948176 B4 5/2004
EP 1091041 A1 * 4/2001 ..... B03D 1/22
GB 1028483 A 5/1966

*Primary Examiner* — Patrick H Mackey
(74) *Attorney, Agent, or Firm* — Slater Matsil, LLP

(57) ABSTRACT

A method and device for slurrying a suspension, the device including a mixing container with an inlet opening configured to introduce the suspension into the mixing container, a distributor element having a collecting container and an outlet arm fastened to the collecting container, and a shaft with a longitudinal axis, with the shaft and the distributor element arranged inside the mixing container, and the distributor element rotatable around the shaft. The collecting container has a collecting opening that permits passage of the suspension from the inlet opening into the distributor element, the outlet arm has an outflow opening that lets the suspension leave the distributor element, and the outlet arm permitting the suspension to flow out of the distributor element, with a flow of the suspension causing a torque on the distributor element so that the torque supports a rotation around the shaft.

15 Claims, 4 Drawing Sheets

(56) References Cited

U.S. PATENT DOCUMENTS

| | | | | |
|---|---|---|---|---|
| 6,109,778 | A * | 8/2000 | Wilmer | B01F 3/0857 366/137 |
| 7,059,759 | B2 * | 6/2006 | Hummer | B01F 5/0218 366/137 |
| 10,058,831 | B2 * | 8/2018 | Telljohann | B41F 31/08 |
| 10,137,420 | B2 * | 11/2018 | Luharuka | B01F 5/248 |

* cited by examiner

DEVICE FOR SLURRYING A SUSPENSION AND METHOD FOR OPERATING A DEVICE

CROSS-REFERENCE TO RELATED APPLICATIONS

This application claims the benefit of German patent application 102017129997.1, filed on Dec. 14, 2017, which application is hereby incorporated herein by reference.

TECHNICAL FIELD

A device for slurrying a suspension is specified. In addition, a method for operating a device is specified.

SUMMARY

Embodiments provide a device for slurrying or mixing a suspension with particles which have a significantly higher density than the carrier liquid. Further embodiments provide a method for operating such a device.

According to at least one embodiment, the device comprises a mixing container with an inlet opening through which the suspension can be introduced into the mixing container.

In particular, the mixing container may be an elongated container. The inlet opening, for example, is located at a longitudinal end of the mixing container. For example, the mixing container comprises a cylindrical section or is cylindrical. The length of the cylindrical section is preferably greater than the diameter of the cylindrical section. The length of the cylindrical section preferably accounts for at least 70% of the total length of the mixing container. The inlet opening is preferably located in the cylindrical section and particularly in a top surface of the cylindrical section.

At a longitudinal end of the mixing container opposite the inlet opening, the mixing container may have a tapered shape, in particular a conical shape.

The mixing container, for example, has a capacity between 0.01 l and 1 l inclusive, preferably between 0.01 l and 0.3 l inclusive.

According to at least one embodiment, the device comprises a distributor element with a collecting container and one or more outlet arms fastened to the collecting container. The distributor element is set up for distributing or mixing the suspension.

The collecting container may be configured for a temporary storage of the suspension. The collecting container may be a hollow body. For example, the collecting container has a capacity of at least 1 ml and not more than 50 ml.

The outlet arm may be an elongated hollow body. The cavity within the outlet arm forms an inner flow channel through which the suspension can flow or stream. The outlet arm, for example, is designed as a tube.

A longitudinal end of the outlet arm may be attached to the collecting container. The opposite longitudinal end is at a distance from the collecting container.

The outlet arm may hydraulically be coupled to the collecting container so that the suspension can flow from the interior of the collecting container into the inner flow channel of the outlet arm.

The components of the distributor element, in particular the collecting container and the outlet arm, may be formed in one piece with each other. This means that all regions of the distributor element are formed integral with each other and contain the same material or consist of the same material.

A distributor element with one outlet arm is described here and in the following. The distributor element can also comprise several outlet arms, for example, two or three or four outlet arms. All specifications made for one outlet arm may apply accordingly to several or all outlet arms. The outlet arms, for example, are evenly distributed around the collecting container.

According to at least one embodiment, the device comprises a shaft with a longitudinal axis. This means that the shaft is preferably elongated, in particular rod-shaped or cylindrical. The longitudinal axis of the shaft preferably extends parallel to a longitudinal axis of the mixing container. The longitudinal axis of the shaft can coincide with the longitudinal axis of the mixing container. The length of the shaft, measured along the longitudinal axis of the mixing container, is preferably at least 30% or at least 50% or at least 70% of a length of the mixing container.

According to at least one embodiment, the shaft and the distributor element are arranged inside the mixing container. Preferably the shaft and the distributor element are completely surrounded by walls of the mixing container.

The device may also include several inlet openings, which may be arranged, for example, uniformly or symmetrically around an extension of the longitudinal axis of the shaft.

According to at least one embodiment, the distributor element is mounted freely rotatable around the shaft. This means that the shaft serves to support the rotatable distributor element. The distributor element can rotate freely around the shaft, especially during the intended operation of the device, i.e., during slurrying or mixing of the suspension.

The shaft preferably runs through the center of the collecting container. For example, the collecting container is designed rotationally symmetrical with regard to rotation around the shaft.

According to at least one embodiment, the collecting container comprises a collecting opening. The suspension can pass from the inlet opening into the distributor element via the collecting opening. The inlet opening is preferably at a distance from the collecting opening. The inlet opening and the collecting opening are preferably facing each other. In particular, the suspension may pass along a straight path from the inlet opening to the collecting opening. Between the inlet opening and the collecting opening there are preferably no elements of the device arranged.

According to at least one embodiment, the outlet arm comprises an outflow opening via which the suspension can leave the distributor element. The outflow opening is particularly formed at the longitudinal end of the outlet arm, which is not attached to the collecting container. The outflow opening thus is one end of inner flow channel of the outlet arm.

According to at least one embodiment, the outlet arm is designed such that the suspension can flow out of the distributor element starting from the collecting container via the outlet arm and the outflow opening, and such a flow of suspension causes a torque onto the distributor element supporting a rotation around the shaft.

During intended operation of the device, the suspension flows from the interior of the collecting container through the outlet arm and exits the outlet arm through the outflow opening. The outlet arm is shaped in such a way that the outflow of the suspension causes the distributor element to rotate around the shaft or at least produces a torque that supports or acts on such rotation. The torque thus affects towards rotation against a resistance of the distributor element, thus against inertia and friction.

In other words, the outflow of the suspension from the outflow opening causes a torque to the distributor element, said torque has a non-vanishing component parallel to the longitudinal axis of the shaft. For example, the torque vector of the torque applied to the distributor element includes an angle with the longitudinal axis of the shaft of not more than 30° or not more than 20° or not more than 10°.

In other words, the outlet arm is shaped so that when the suspension flows through the outlet arm, the component of the mean angular momentum of the suspension is changed along the longitudinal axis. By angular momentum conservation, a torque component parallel to the longitudinal axis is then applied to the distributor element.

The longitudinal axis of the shaft represents a z-axis in a polar coordinate system. During intended operation, the suspension has an average velocity when the suspension flows out of the outflow opening. The outlet arm is preferably designed in such a way that a component of the mean velocity of the suspension is greater in amount for the azimuthal direction than for the radial direction and/or for the z-direction. The azimuthal direction is a direction perpendicular to the z-axis and perpendicular to the radial direction.

In order to produce such a torque when flowing through and flowing out, the outlet arm can first extend away from the shaft, for example, essentially in the radial direction and/or parallel to the z-axis, starting from the collecting container. The outlet arm can then be curved so that an extension along the azimuthal direction increases. In the region of the outflow opening, the extension along the azimuthal direction is preferably greater than along the radial direction and/or the z-axis.

In other words, the outlet arm extends along a centerline. The center line, for example, runs through the center of the inner flow channel. Starting from the collecting container up to the outflow opening, an orientation of the centerline along the azimuthal direction preferably increases. This means that tangential vectors placed at points of the centerline have a larger component for the azimuthal direction, the closer the point is to the outflow opening. A tangential vector to the centerline in the region of the outflow opening preferentially has a larger component for the azimuthal direction than for the z-direction and/or than for the radial direction.

If the device comprises several outlet arms, the outlet arms are preferably of the same shape, so that a flow of the suspension through the outlet arms supports a rotation with always the same direction of rotation.

A suspension for which the device is designed to slurry and with which the device functions as intended has a viscosity of, for example, not more than 100 mPa·s or not more than 70 mPa·s or not more than 50 mPa·s or not more than 15 mPa·s.

In at least one embodiment, the device for slurrying a suspension comprises a mixing container with an inlet opening through which the suspension can be introduced into the mixing container. The device also comprises a distributor element with a collecting container and an outlet arm fastened to the collecting container, and a shaft with a longitudinal axis. The shaft and the distributor element are located inside the mixing container. The distributor element is mounted freely rotatable around the shaft. The collecting container comprises a collecting opening via which the suspension can pass from the inlet opening into the distributor element. The outlet arm has an outflow opening via which the suspension can leave the distributor element. The outlet arm is designed such that the suspension can flow out of the distributor element starting from the collecting container via the outlet arm and the outflow opening, and such a flow of the suspension causes a torque onto the distributor element, said torque supports a rotation around the shaft.

Embodiments of the invention are based in particular on the knowledge that a conversion layer is used to convert the light emitted by a light-emitting diode. The conversion layer comprises fluorescent particles (converter particles) distributed in a carrier matrix. One method of applying such a conversion layer is to spray a liquid particle suspension, also called slurry, comprising, for example, silicone, converter particles and a diluent, such as n-heptane, from a cartridge onto a semiconductor device.

For typical material properties, the sedimentation time of the converter particles in a static suspension is a few minutes. Sedimentation times are particularly short for suspensions with a low viscosity, such as those required for spraying. In order to meet the quality requirements for constant properties of the final conversion layer, the suspension should, however, remain homogeneously mixed throughout the entire spraying process, which is approximately 1 hour for the capacity of commonly used cartridges (mixing containers). This means that the converter particles should not concentrate or sediment in a partial volume of the mixing container. To achieve this, the suspension can be actively mixed.

In embodiments of the invention, mixing can be achieved with a single mixing container. For this purpose, a suspension is introduced into the mixing container via an inlet opening. From the inlet opening, the suspension first passes to a distributor element, which is freely rotatable around a shaft. The mixing is achieved by the fact that the distributor element comprises an outlet arm through which the suspension leaves the distributor element again. The outlet arm is designed in such a way that leaving of the suspension automatically leads to a rotation of the distributor element. This, in turn, results in the jet of suspension supplied to the mixing container being supplied in a rotating manner. In addition, the automatic rotation of the distributor element is subject to small stochastic fluctuations. Overall, the formation of stable vortices and currents within the suspension can be reduced, which reduces the risk of sedimentation.

Another advantage is that the rotation of the distributor element is automatic or passive. This means that the distributor element does not have to be actively rotated, for example, via a motor. Therefore, a pressure-tight passage through a lid of the mixing container is not necessary.

In summary, constant removal of the suspension from the mixing container and subsequent return to the mixing container may ensure that the particles, such as converter particles, do not settle along the z-axis or gravitational direction. The rotation occurring during the return also causes a redistribution of the particles in the directions perpendicular to the z-axis, so that the particles are redistributed overall in all spatial directions.

According to at least one embodiment, the distributor element is mounted so as to be freely displaceable along the longitudinal axis of the shaft. In particular during the intended operation of the device, the distributor element is freely displaceable along the longitudinal axis of the shaft so that the position of the distributor element along the longitudinal axis can be changed also during operation.

According to at least one embodiment, the longitudinal axis of the shaft is aligned substantially parallel to the gravitational direction in an intended orientation of the device. The intended orientation of the device is the geometric orientation for the intended operation of the device. "Substantially parallel" in this case means that the longitudinal axis includes an angle of at most 30° or at most 20° or at most 10° or at most 5° with the gravitational direction.

According to at least one embodiment, in the intended orientation, the collecting opening is arranged downstream of the inlet opening in the gravitational direction. This means that suspension fed through the inlet opening falls into the collecting opening due to gravity.

According to at least one embodiment, when viewed in a direction along the longitudinal axis of the shaft, the collecting opening completely covers the inlet opening. This applies preferably to any position of the distributor element adjustable by rotation around the shaft and/or displacement along the longitudinal axis of the shaft. In particular, the collecting opening is therefore larger than the inlet opening. During intended operation, for example, at least 90% or at least 95% of the suspension supplied via the inlet opening reaches the collecting opening of the collecting container.

According to at least one embodiment, the mixing container can be filled with the suspension. This means that a suspension introduced into the mixing container can be stored inside the mixing container.

According to at least one embodiment, the distributor element is designed such that when the mixing container is partially filled with the suspension and the device is aligned as intended, the distributor element floats in the suspension. For example, the distributor element floats in the mixing container when the volume of suspension in the mixing container is at least 30% of the capacity of the mixing container. In this case, "floating" means in particular that when the filling level of the suspension in the mixing container changes, the distributor element automatically follows the changing filling level.

The fact that the distributor element floats in the suspension inside the mixing container is made possible on the one hand by the choice of the material of the distributor element and on the other hand by the free displaceability along the longitudinal direction of the shaft.

The distributor element, for example, comprises or consists of plastic. The distributor element can, for example, be manufactured using a 3D printing process. The distributor element can also comprise a metal or ceramic. In addition, the distributor element can include a float which provides the buoyancy in the suspension required for swimming.

For example, a suspension used for the device in which the distributor element floats has a density of at least 0.5 g/cm3 or at least 0.6 g/cm3 or at least 0.7 g/cm3 or at least 0.8 g/cm3 or at least 0.9 g/cm3. Alternatively or additionally, the density of the suspension may be at most 2 g/cm3 or at most 1.7 g/cm3 or at most 1.5 g/cm3 or at most 1.3 g/cm3 or at most 1.1 g/cm3.

The floating of the distributor element in the suspension has the consequence that the distributor element follows a changing filling level of the suspension in the mixing container and thus the mixing or homogeneity of the returned suspension does not decrease with decreasing filling level.

According to at least one embodiment, the distributor element is designed such that when the distributor element floats in the suspension, the outflow opening is completely submerged in the suspension. The entire outlet arm is then preferably submerged in the suspension. This has the particular advantage that during operation a rotation of the distributor element around the shaft additionally stirs the suspension already present in the mixing container.

According to at least one embodiment, the inlet opening is offset with respect to the shaft in a direction perpendicular to the longitudinal axis of the shaft. For example, a diameter of the mixing container, measured in the direction perpendicular to the longitudinal axis of the shaft, is at least 1 cm or at least 2 cm or at least 5 cm. Alternatively or additionally, the mixing container may have a diameter of at most 50 cm or at most 30 cm. For example, the distance between the inlet opening and the longitudinal axis of the shaft is between 5% and 50% inclusive, preferably between 5% and 25% inclusive of the diameter of the mixing container.

According to at least one embodiment, an interior of the outlet arm, for example, the inner flow channel, is connected to an interior of the collecting container via an inflow opening in an outer wall of the collecting container, so that the suspension can pass from the interior of the collecting container via the inflow opening into the interior of the outlet arm. The cavities of the collecting container and the outlet arm are thus contiguous through the inflow opening.

For example, a diameter of the inflow opening in the outer wall of the collecting container corresponds to a diameter of the inner flow channel of the outlet arm. The outer wall of the collecting container preferably merges directly into an outer wall of the outlet arm.

According to at least one embodiment, when the distributor element rotates around the shaft, there is at least one position in which, when viewed in a direction along the longitudinal axis of the shaft, the inflow opening at least partially covers, preferably completely covers, the inlet opening. In this position, suspension supplied through the inlet opening can fall directly into the inflow opening when the device is orientated as intended.

Such a direct and linear connection between the inlet opening of the mixing container and the inflow opening has the advantage that a supplied suspension is not decelerated or only slightly decelerated before it reaches the outlet arm. The redirection of the suspension within the outlet arm therefore produces a particularly high torque on the distributor element.

According to at least one embodiment, the collecting container has the geometric shape of a hollow dome. The collecting opening is located in the region of the base of the hollow dome and forms, for example, at least 80% of the base of the hollow dome. The tip of the hollow dome is preferably facing away from the inlet opening. In the intended orientation of the device, the tip of the hollow dome thus points downwards. The collecting container can have the shape of a hemispherical bowl.

For example, the extension of the collecting container along the longitudinal axis of the shaft and in the direction perpendicular to the longitudinal axis of the shaft is at most 100 mm or at most 70 mm or at most 50 mm or less. Alternatively or in addition, the extensions are at least 5 mm or at least 10 mm or at least 20 mm.

The shaft preferably extends from the base surface of the hollow dome through the tip of the hollow dome.

According to at least one embodiment, the mixing container has an outlet opening via which the suspension can be removed from the mixing container. In an elongated mixing container, the inlet and outlet openings are preferably located at opposite longitudinal ends of the mixing container. In particular, when the device is orientated as intended, the outlet opening is located in the lower part of the mixing container. The inlet opening is preferably located in the upper part of the mixing container. In the gravitational direction, the outlet opening is then arranged downstream of the inlet opening.

According to at least one embodiment, the outlet opening is offset with respect to the inlet opening in a direction perpendicular to the longitudinal axis of the shaft. Such an offset between the inlet opening and the outlet opening also has a positive effect on the mixing of the suspension.

According to at least one embodiment, the mixing container has a side wall spaced from the shaft in the direction perpendicular to the longitudinal axis of the shaft. The side wall can, for example, be the outer surface of a cylinder if the mixing container is cylindrical or cylindrical in sections.

According to at least one embodiment, the distance between the outflow opening of the distributor element to the shaft is between 50% and 75% of the distance between the side wall to the shaft. The distances are measured along a direction perpendicular to the longitudinal axis of the shaft.

According to at least one embodiment, the distributor element has a passage. The shaft is passed through the passage.

According to at least one embodiment, a diameter of the passage is at least 100 μm or at least 300 μm or at least 500 μm larger than a diameter of the shaft, so that a gap is formed between the distributor element and the shaft. For example, the gap is freely accessible for the suspension. In particular, the size of the gap is chosen so that particles of the suspension pass through the gap without blocking the rotation of the distributor element around the shaft.

According to at least one embodiment, the device comprises a return system which is configured so that it can convey at least a portion of a suspension removed from the outlet opening via the inlet opening back into the mixing container. The return system includes, for example, a pump with which the removed suspension can be conveyed back into the mixing container. A valve, such as a three-way valve, is also preferably installed in the return system, which can be used to control which portion of the removed suspension is conveyed back and which portion, for example, is sprayed onto semiconductor components.

In addition, a method for operating a device in accordance with one or more of the above embodiments is specified. All features disclosed in connection with the device are therefore also disclosed for the method and vice versa.

According to at least one embodiment, the method for operating the device comprises a step A) in which the device is oriented such that the longitudinal axis of the shaft is oriented substantially parallel to the gravitational direction and the distributor element is arranged downstream of the inlet opening in the gravitational direction.

According to at least one embodiment, the method comprises a step B) in which a suspension with converter particles is introduced into the mixing container via the inlet opening, so that the suspension first passes via the collecting opening into the distributor element and then flows out of the distributor element via the outflow opening, whereby the distributor element is set in rotation around the shaft.

The rotation around the shaft is preferably automatic, i.e., without any additional external force being applied to the shaft or the distributor element, simply by the outflow of the suspension from the outflow opening.

During the method, the suspension falls from the inlet opening to the collecting opening of the distributor element. Preferably, however, the suspension is introduced into the mixing container under pressure. This means that the suspension is fed through the inlet opening at an initial speed greater than zero.

According to at least one embodiment of the method, the mixing container is at least temporarily partially filled with the suspension during the method. For example, during the method at least 30% or at least 50% of the capacity of the mixing container is filled with the suspension over a period of more than 1 minute.

According to at least one embodiment, the distributor element floats in the suspension at least temporarily during the method, for example, over a period of at least 1 minute.

According to at least one embodiment, the filling level of the suspension in the mixing container changes during the method. In particular, the filling level of the mixing container decreases during the method.

According to at least one embodiment, during the method, the distributor element follows the change in filling level by moving along the longitudinal axis of the shaft.

According to at least one embodiment, the suspension has a density between 0.6 g/cm3 and 2 g/cm3 inclusive.

According to at least one embodiment, the suspension has a viscosity between 1 mPa·s and 100 mPa·s inclusive, preferably between 1 mPa·s and 50 mPa·s inclusive.

According to at least one embodiment, the suspension passes through the inlet opening at an average velocity of at least 0.01 m/s or at least 0.1 m/s. Alternatively or in addition, the average velocity may be at most 5 m/s or at most or 1 m/s. The average velocity can be locally averaged and/or time-averaged. In particular, the suspension is injected into the mixing container via the inlet opening. For example, a pump is used for this purpose.

According to at least one embodiment, the converter particles of the suspension have a maximum diameter of at most 500 μm or at most 300 μm or at most 100 μm.

According to at least one embodiment, the method comprises a step C) in which the suspension is removed from the mixing container. Only a part of the suspension in the mixing container is preferably removed. In particular, the suspension is removed from the mixing container via an outlet opening.

According to at least one embodiment, the method comprises a step D) in which at least part of the removed suspension is sprayed onto semiconductor components, such as semiconductor chips, in particular LED chips.

During the method, a constant or variable/controllable overpressure is preferred inside the mixing container. The pressure in the mixing container is preferably increased with decreasing filling level of the suspension. The overpressure in the mixing container, for example, is between 30 mbar and 100 mbar inclusive.

BRIEF DESCRIPTION OF THE DRAWINGS

In the following, a device described herein as well as a method for operating the device described herein is described with reference to drawings by means of exemplary embodiments. Here, like reference numerals indicate like elements in the figures. However, the size ratios involved are not to scale, individual elements may rather be illustrated with an exaggerated size for a better understanding.

DETAILED DESCRIPTION OF ILLUSTRATIVE EMBODIMENTS

Figure 1A:
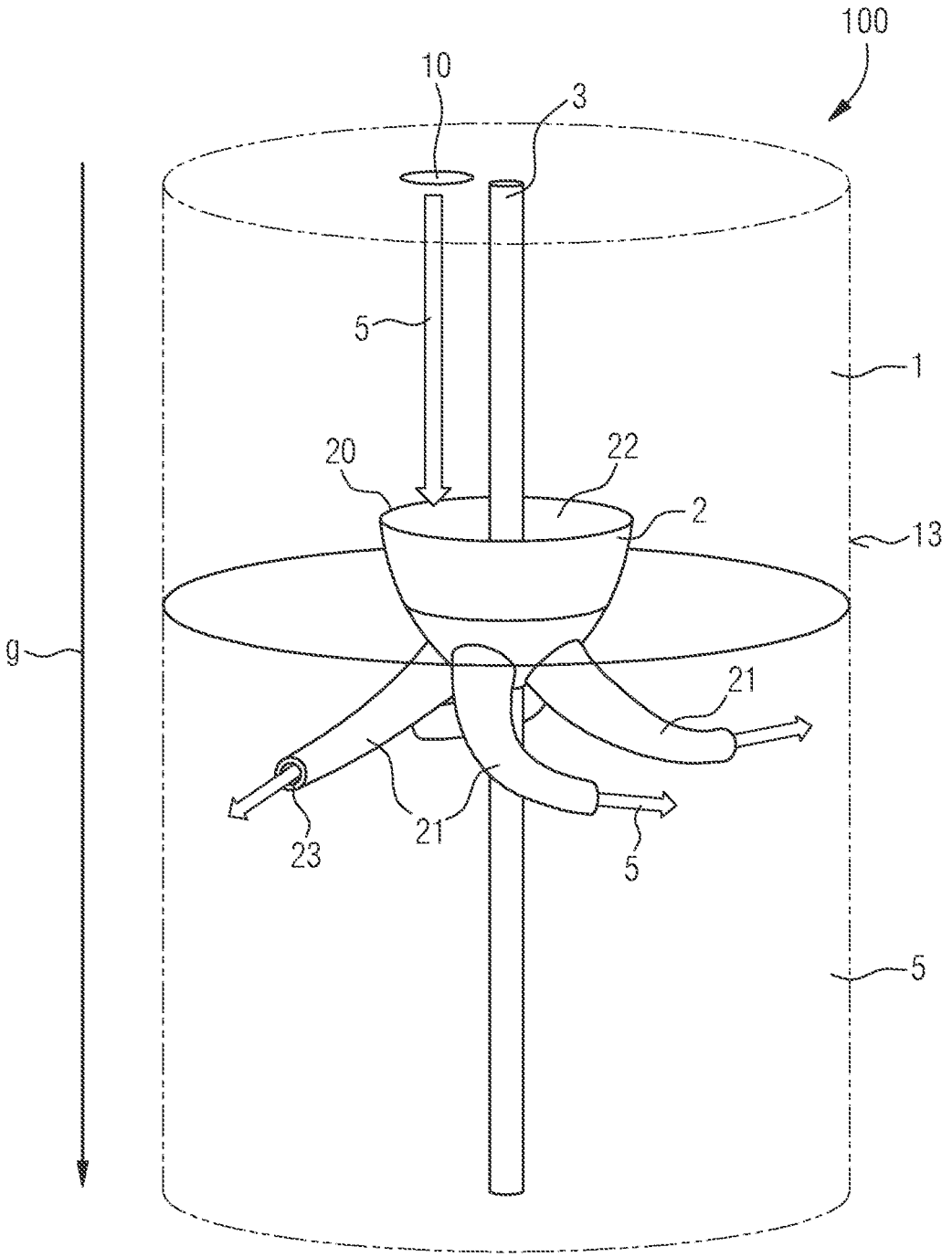
FIGS. 1A to 1C show exemplary embodiments of the device in different views.

FIG. 1A shows an example of a device 100 for slurrying a suspension 5 in perspective. The device boo comprises a mixing container 1, which is cylindrical in shape. The mixing container 1 is partly filled with the suspension 5. The suspension 5 may, for example, have been introduced through the inlet opening 10 in the upper part of the mixing container 1. The suspension 5, for example, contains converter particles.

In the mixing container 1, a shaft 3 extends along the longitudinal direction of the mixing container 1. A longitudinal axis of the shaft 3 corresponds here to the longitudinal axis of the cylindrical mixing container 1. The longitudinal axis of the shaft 3 is essentially aligned parallel to the gravitational direction g.

A distributor element 2 is mounted so that it can rotate freely around the shaft 3. For this purpose, the distributor element 2 comprises in particular a passage through which the shaft 3 is guided.

The distributor element 2 comprises a collecting container 20. The collecting container 20 has the shape of an inverted hollow dome. The base of the hollow dome comprises a collecting opening 22 of the collecting container 20. In particular, the collecting opening 22 is arranged downstream of the inlet opening 10 in the gravitational direction or in the direction parallel to the longitudinal axis of the shaft 3. If the suspension 5 is introduced into the mixing container 1 via the inlet opening 10, it falls directly through the collecting opening 22 into the collecting container 20.

Outlet arms 21 are attached to an outer wall of the collecting container 20. The outlet arms 21, for example, are formed as tubes, which comprise an inner flow channel. The suspension 5 can pass from the collecting container 20 into the outlet arms 21 and flow through the inner flow channels of the outlet arms 21.

At one end of outlet arms 21, the outlet arms 21 each have an outflow opening 23. The suspension 5 can leave the outlet arms 21 or the distributor element 2 via the outflow opening 23.

The outlet arms 21 are curved in such a way that when the suspension 5 flows out, a torque is generated on the distributor element 2 which supports or causes the distributor element 2 to rotate around the shaft 3. The outflowing suspension 5 is marked by arrows in FIG. 1A.

FIG. 1A also shows that distributor element 2 floats in suspension 5. If the filling level of the suspension 5 in the mixing container 1 changes, the distributor element 2 follows the filling level of the suspension 5. For this purpose, the distributor element 2 is mounted so that it can move freely, especially along the longitudinal direction of the shaft 3. The distributor element 2 is designed in such a way that the outflow openings 23 of the outlet arms 21 are immersed in the suspension 5.

Figure 1B:
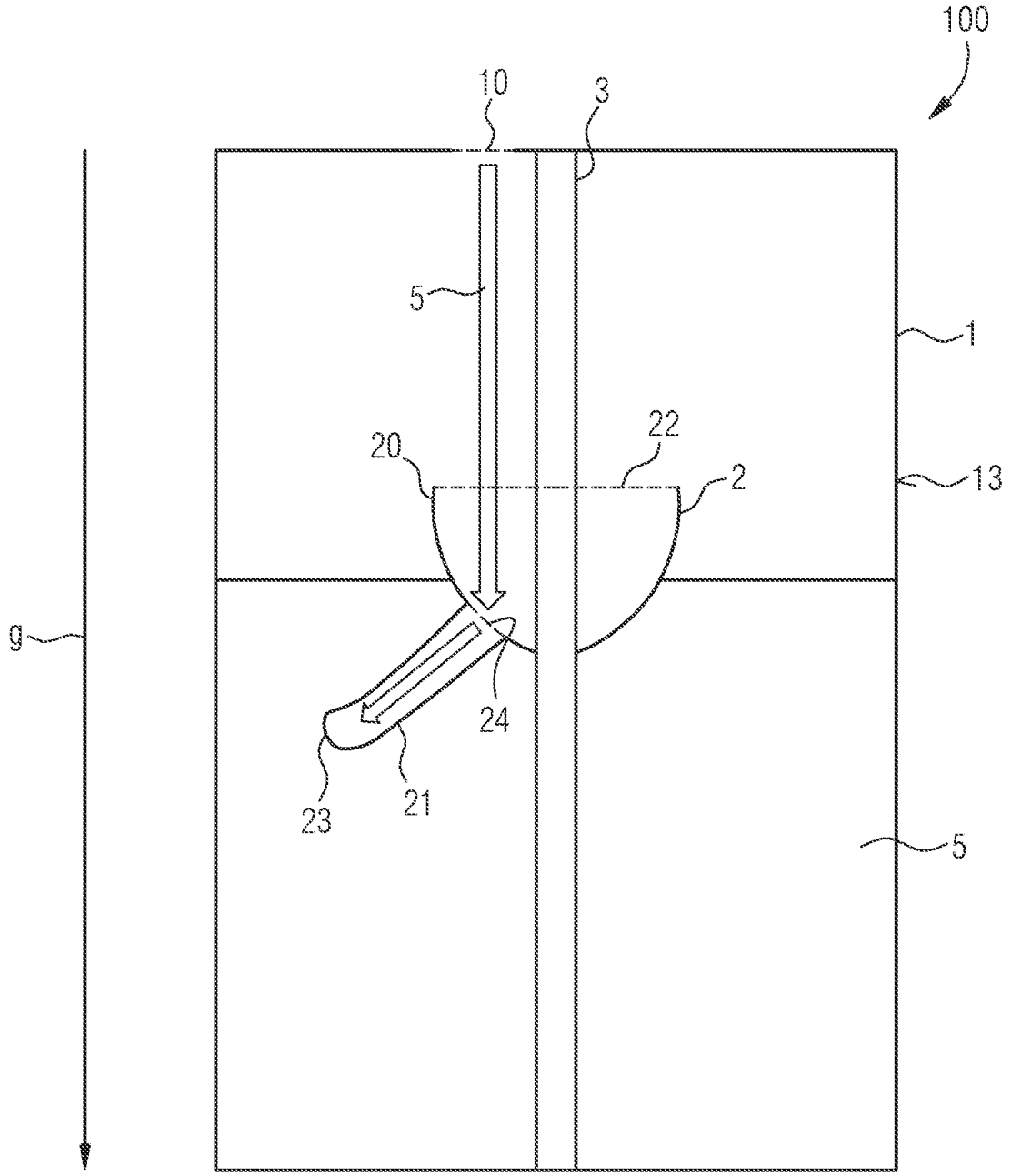

FIG. 1B shows a cross-sectional view of the device 100 of FIG. 1A. It can be seen that an inflow opening 24 is formed in the outer wall of the collecting container 20, to which the inner flow channel of the outlet arm 21 is connected. The suspension 5 in the collecting container 20 can reach the outlet arm 21 via the inflow opening 24.

FIG. 1B also shows that, when looking along the longitudinal axis of shaft 3, the inflow opening 24 covers the inlet opening 10 for certain rotation angles of the distributor element. When the device 100 is aligned as intended with the longitudinal axis of the shaft 3 along the gravitational direction g as shown in FIG. 1B, this ensures that the suspension 5 flowing in via the inlet opening 10 hits the inflow opening 24 directly. The torque caused by the deflection of the suspension 5 to the distributor element 2 is thus maximized.

FIG. 1B also shows that a side wall 13 of the mixing container 1 is spaced from the shaft 3 in a direction perpendicular to the longitudinal axis of shaft 3. The distance between the outflow opening 23 and the shaft 3 is approximately ⅔ of the distance between the side wall 13 and the shaft 3.

Figure 1C:
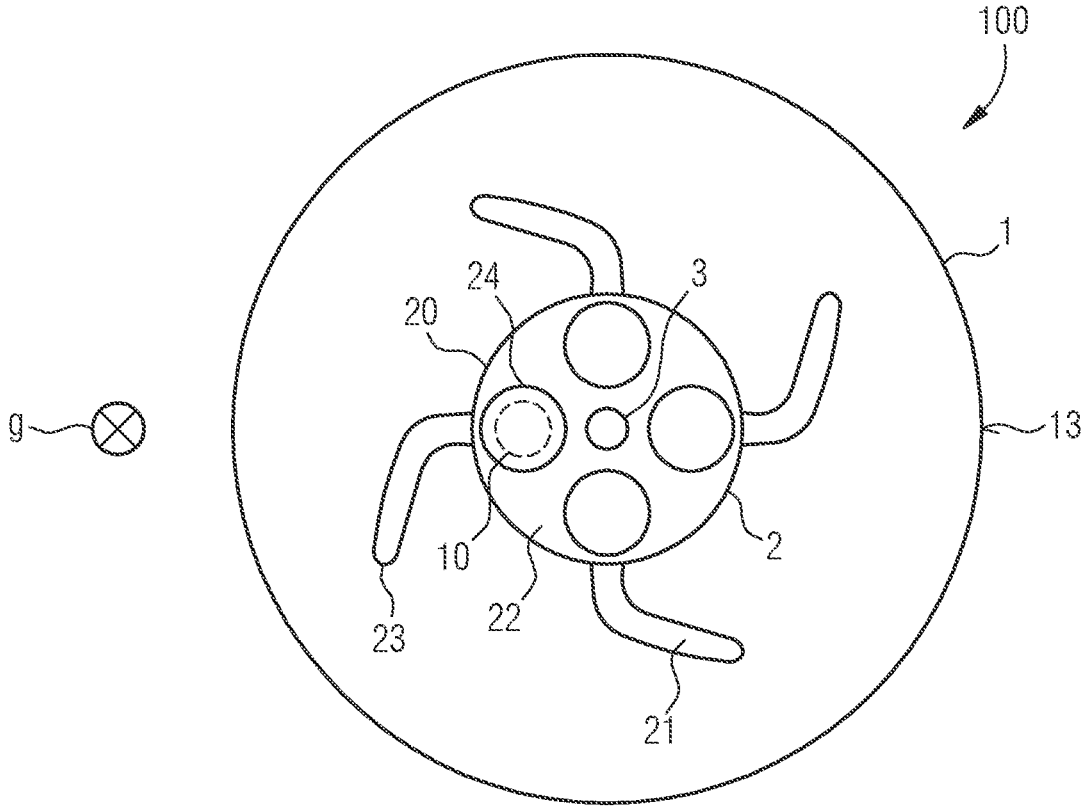

FIG. 1C shows the device 100 of FIG. 1A in a cross-sectional view perpendicular to the longitudinal axis of shaft 3. The distributor element 2 comprises four outlet arms 21 in this case. The outlet arms 21 are each curved in the same way, so that when a suspension 5 flows through them, they each support a rotation with the same direction of rotation around the longitudinal axis of the shaft 3.

FIG. 1C also shows that the collecting opening 22 of the collecting container 20 completely covers the inlet opening 10. It can also be seen that when the distributor element 2 rotates around the shaft 3, there are four positions in which the inlet opening 10 is completely overlapped by an inflow opening 24.

Other than shown in FIG. 1C, the device 100 can also include several inlet openings 10.

Figure 2:
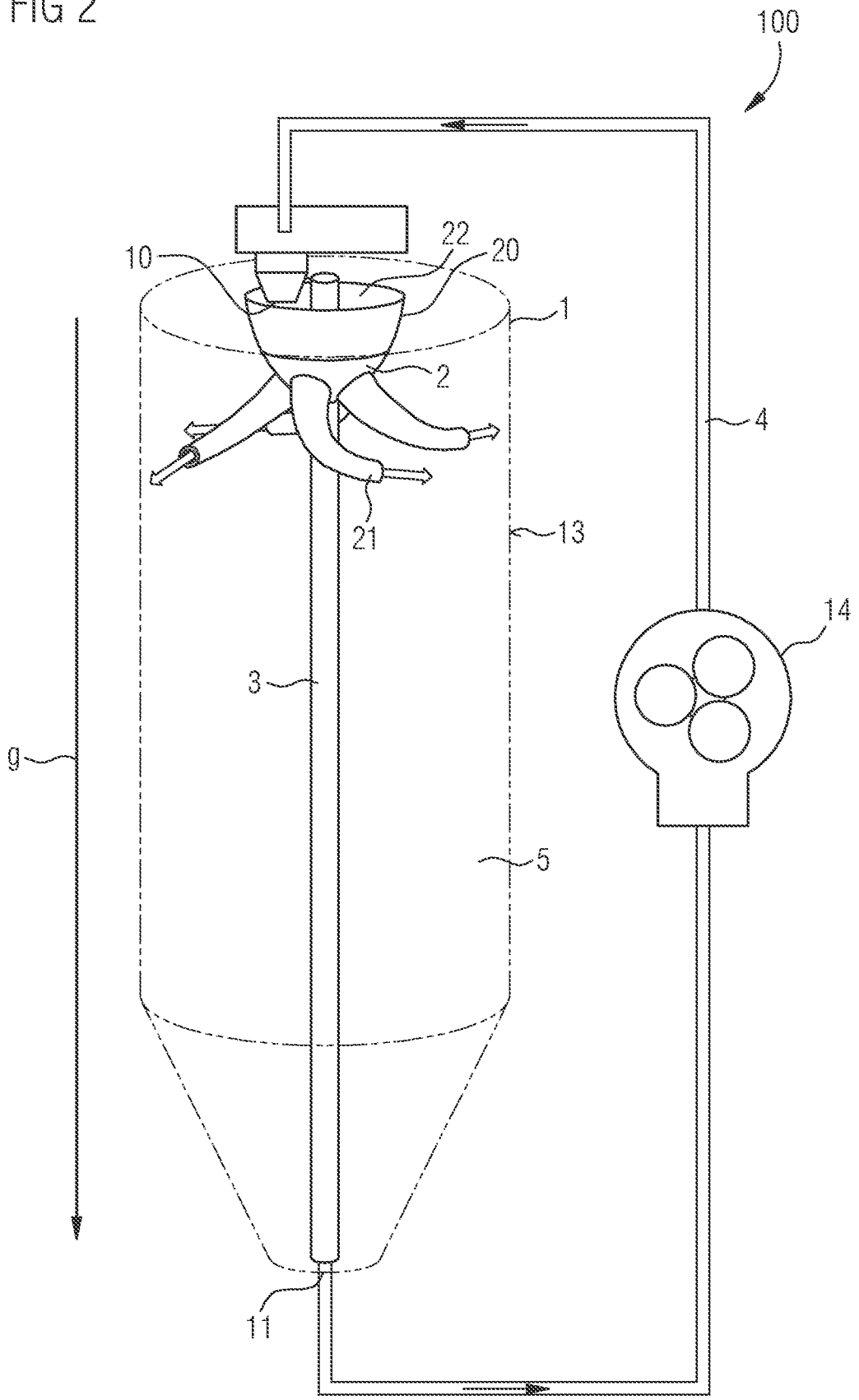
FIG. 2 shows an exemplary embodiment of the device and of the method for operating the device.

FIG. 2 shows another example of a device 100 for slurrying a suspension 5. The mixing container 1 comprises an outlet opening 11 through which the suspension 5 in the mixing container 1 can be removed. The outlet opening 11 is arranged downstream of the inlet opening 10 in the gravitational direction g. The inlet opening 10 and the outlet opening 11 may be the only openings in the mixing container wall.

The device 100 also comprises a return system 4 with a pump 14. Suspension 5 removed through the outlet opening 11 is pumped completely or partially back into the mixing container 1 by means of the return system 4. The returned suspension 5 enters the mixing container 1 via the inlet opening 10. After entering the mixing container 1, the suspension 5 first falls into the collecting container 20, from where the suspension 5 flows out of the distributor element 2 through the outlet arms 21. The shape of the outlet arms 21 results in an automatic rotation of the distributor element 2 around the shaft 3. Due to this the suspension 5 is constantly mixed, so that returned particles in the suspension 5 are homogeneously distributed in the suspension 5.

The invention described herein is not limited by the description in conjunction with the exemplary embodiments. Rather, the invention comprises any new feature as well as any combination of features, particularly including any combination of features in the patent claims, even if said feature or said combination per se is not explicitly stated in the patent claims or exemplary embodiments.

What is claimed is:

1. A device for slurrying a suspension comprising:

a mixing container with an inlet opening configured to introduce the suspension into the mixing container;

a distributor element having a collecting container and an outlet arm fastened to the collecting container; and a shaft with a longitudinal axis, wherein the shaft and the distributor element are arranged inside the mixing container, wherein the distributor element is mounted so as to be freely rotatable around the shaft, wherein the collecting container comprises a collecting opening configured to pass the suspension from the inlet opening into the distributor element, wherein the outlet arm comprises an outflow opening configured to let the suspension leave the distributor element, wherein the outlet arm is designed such that the suspension is able to flow out of the distributor element starting from the collecting container via the outlet arm and the outflow opening, a flow of the suspension causing a torque on the distributor element so that the torque supports a rotation around the shaft;

wherein the longitudinal axis of the shaft is oriented substantially parallel to a gravitational direction;

wherein the collecting opening is arranged downstream of the inlet opening in the gravitational direction;

wherein, with respect to a viewing direction along the longitudinal axis of the shaft, the collecting opening completely covers the inlet opening;

wherein the mixing container is configured to be filled with the suspension; and wherein the distributor element is designed such that when the mixing container is at least partially filled with the suspension the distributor element floats in the suspension.

2. The device according to claim 1, wherein the distributor element is designed such that when the distributor element floats in the suspension the outflow opening is completely submerged in the suspension.

3. The device according to claim 1, wherein the inlet opening is offset with respect to the shaft in a direction perpendicular to the longitudinal axis of the shaft.

4. The device according to claim 1, wherein an interior of the outlet arm is connected via an inflow opening in an outer wall of the collecting container to an interior of the collecting container so that the suspension is able to pass from the interior of the collecting container via the inflow opening into the interior of the outlet arm when the distributor element rotates around the shaft, and wherein at least one position exists in which the inflow opening at least partially covers the inlet opening.

5. The device according to claim 1, wherein the collecting container has a geometric shape of a hollow dome.

6. The device according to claim 1, wherein the mixing container has an outlet opening configured to remove the suspension from the mixing container, and wherein the outlet opening is offset with respect to the inlet opening in a direction perpendicular to the longitudinal axis of the shaft.

7. The device according to claim 6, further comprising a return system configured to convey at least a portion of a suspension removed from the outlet opening back into the mixing container via the inlet opening.

8. The device according to claim 1, wherein the mixing container has a side wall which is spaced from the shaft in a direction perpendicular to the longitudinal axis of the shaft, and wherein a distance of the outflow opening to the shaft is between 50% and 75% inclusive of a distance of the side wall to the shaft.

9. The device according to claim 1, wherein the distributor element has a passage through which the shaft is guided, and wherein a diameter of the passage is at least 100 μm larger than a diameter of the shaft so that a gap exists between the distributor element and the shaft.

10. The device according to claim 1, wherein the distributor element is mounted so as to be freely displaceable along the longitudinal axis of the shaft.

11. A method for operating a device having a mixing container with an inlet opening configured to introduce a suspension into the mixing container, further having a distributor element having a collecting container and an outlet arm fastened to the collecting container, and further having a shaft with a longitudinal axis, the method comprising:

orientating the device such that the longitudinal axis of the shaft is aligned substantially parallel to a gravitational direction and the distributor element is arranged downstream of the inlet opening in the gravitational direction, wherein the shaft and the distributor element are arranged inside the mixing container, wherein the distributor element is mounted so as to be freely rotatable around the shaft wherein the collecting container comprises a collecting opening configured to pass the suspension from the inlet opening into the distributor element, wherein the outlet arm comprises an outflow opening configured to let the suspension leave the distributor element, and wherein the outlet arm is designed such that the suspension is able to flow out of the distributor element starting from the collecting container via the outlet arm and the outflow opening, a flow of the suspension causing a torque on the distributor element so that the torque supports a rotation around the shaft;

introducing the suspension with converter particles into the mixing container via the inlet opening so that the suspension first passes via the collecting opening into the distributor element and then flows out of the distributor element via the outflow opening as a result of which the distributor element is set in rotation around the shaft;

wherein the mixing container is at least temporarily partially filled with the suspension; and wherein the distributor element floats at least temporarily in the suspension.

12. The method according to claim 11, wherein a filling level of the suspension in the mixing container changes, and wherein the distributor element follows a change in filling level by moving along the longitudinal axis of the shaft.

13. The method according to claim 11, wherein the suspension has a density between 0.5 g/cm3 and 2 g/cm3 inclusive, wherein the suspension has a viscosity between 1 mPa·s and 100 mPa·s inclusive, and wherein the suspension passes the inlet opening at an average velocity between 0.01 m/s and 5 m/s inclusive.

14. The method according to claim 11, further comprising:

removing the suspension from the mixing container; and spraying at least a part of the removed suspension onto semiconductor components.

15. A device for slurrying a suspension comprising:

a mixing container with an inlet opening configured to introduce the suspension into the mixing container;

a distributor element having a collecting container and an outlet arm fastened to the collecting container; and a shaft with a longitudinal axis, wherein the shaft and the distributor element are arranged inside the mixing container;

wherein the inlet opening is offset with respect to the shaft in a direction perpendicular to the longitudinal axis of the shaft;

wherein the distributor element is mounted so as to be freely rotatable around the shaft;

wherein the collecting container comprises a collecting opening configured to pass the suspension from the inlet opening into the distributor element;

wherein the outlet arm comprises an outflow opening configured to let the suspension leave the distributor element; and wherein the outlet arm is designed such that the suspension is able to flow out of the distributor element starting from the collecting container via the outlet arm and the outflow opening, a flow of the suspension causing a torque on the distributor element so that the torque supports a rotation around the shaft.

* * * * *